US006440234B1

(12) United States Patent
Amaya et al.

(10) Patent No.: US 6,440,234 B1
(45) Date of Patent: Aug. 27, 2002

(54) MARTENSITIC STAINLESS STEEL PRODUCTS

(75) Inventors: Hisashi Amaya, Kyoto; Toshiro Anraku, Nishinomiya; Yasuyoshi Hidaka, Kobe, all of (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/453,714

(22) Filed: Dec. 3, 1999

(30) Foreign Application Priority Data

Dec. 8, 1998 (JP) ..... 10-348187
Aug. 18, 1999 (JP) ..... 11-231382

(51) Int. Cl.[7] ..... C22C 38/18
(52) U.S. Cl. ..... 148/325; 148/909
(58) Field of Search ..... 148/325, 909

(56) References Cited

U.S. PATENT DOCUMENTS

| | | | |
|---|---|---|---|
| 4,076,566 | A | 2/1978 | Power |
| 5,181,970 | A | 1/1993 | Ueda et al. |
| 5,554,235 | A | 9/1996 | Noe et al. |

FOREIGN PATENT DOCUMENTS

| | | | | |
|---|---|---|---|---|
| EP | 0375384 | | | 6/1990 |
| EP | 0533211 | A1 | | 3/1993 |
| EP | 0937782 | A2 | | 8/1999 |
| JP | 53-106622 | | * | 9/1978 |
| JP | 60-263671 | A | | 12/1985 |
| JP | 63-22271 | A | | 1/1988 |
| JP | 06270065 | A | | 9/1994 |
| JP | 07113142 | A | | 5/1995 |
| JP | 07188862 | A | | 7/1995 |
| JP | 7-258733 | | * | 10/1995 |
| JP | 10017986 | A | | 1/1998 |
| JP | 11-236651 | | * | 8/1999 |

* cited by examiner

*Primary Examiner*—Deborah Yee
(74) *Attorney, Agent, or Firm*—Burns, Doane, Swecker & Mathis, LLP

(57) ABSTRACT

A martensitic stainless steel product having a chromium content of 9 to 15% by weight and a surface from which mill scales generated during production are removed by a shot blasting. The surface satisfies that, when a color image of the surface taken with 640×480 pixels is analyzed on blue color and a histogram of the pixel numbers and the tones divided into 0 to 255 classes is obtained, a relationship between the maximum frequency Yp and the tone value Xp at which Yp is counted satisfies an inequality, $800Xp-Yp-27000>0$. This steel product is superior in weatherability under atmospheric environments, and also superior in sulfide stress cracking resistance under environments containing hydro-sulfide.

10 Claims, 2 Drawing Sheets

MARTENSITIC STAINLESS STEEL PRODUCTS

This application claims priority under 35U.S.C. §§119 and/or 365 to Japanese Patent Application No. 10-348187 and No. 11-231382 filed in Japan on Dec. 8, 1998 and Aug. 18, 1999, respectively, the entire content of which is herein incorporated by reference.

BACKGROUND OF THE INVENTION

The present invention relates to a martensitic stainless steel product containing chromium in the range of 9 to 15% by weight, which is mainly used under environments containing hydro-sulfide such as oil wells and gas wells (hereinafter, referred to simply as "oil well") or chemical plants. In particular, the present invention concerns a martensitic stainless steel product which is superior in weatherability under atmospheric environments during transportation and storage, and also superior in corrosion resistance, more specifically, in sulfide stress cracking resistance, even Linder environments containing hydro-sulfide.

With respect to steel products widely used in the application under oil well environments, steel pipes, steel sheets, etc. are listed, and among these, the steel pipes include seamless steel pipes and welded steel pipes.

One of the typical production methods for seamless steel pipes is the so-called Mannesmann-mandrel mill method, and this method is widely used because of its superior dimensional precision and productivity.

Its pipe making process generally consists of a heating process in which a round billet as a material is heated to a predetermined processing temperature, a piercing process in which the heated round billet is formed into a hollow shell by using a piercing mill, an elongating process in which the hollow shell is formed into a pipe for finish rolling by using a mandrel mill, a re-heating process in which the pipe for finish rolling is again heated, and a finish rolling process in which the pipe for finish rolling thus again heated is shaped so as to have a predetermined product dimension by using a stretch reducing mill.

In this case, in general, the heating temperature of the material round billet is set at 1100 to 1300° C., the pipe temperature after the elongating process by the mandrel mill is set at 800 to 1000° C., the reheating temperature of the pipe for finish rolling is set at 850 to 1100° C., and the finish temperature by the stretch reducing mill is set at 800 to 1000° C.

In the case of welded steel pipes, a steel sheet as a material is finished so as to have a predetermined product dimension by using a method, such as an ERW (electric-resistance welding)-pipe making method, a UO-(UO press-submerged arc welding)-pipe making method, and a laser welding-pipe making method.

Thereafter, in the case of the steel pipe made of martensitic stainless steel containing chromium in the range of 9 to 15% by weight (hereinafter, referred to simply as "martensitic stainless steel pipe"), the product is further subjected to a quenching process at not less than 900° C., and then to a tempering process at 600 to 750° C. so as to impart a predetermined strength.

During the producing process of such a martensitic stainless seamless steel pipe or steel plate for welded steel pipe, in the case of the seamless steel pipe, it is subjected to a heat treatment of 600 to 1300° C. during the respective processes, and in the case of the welded steel pipe, a steel plate is subjected to heating at 600 to 1000° C. during a formation process into a steel pipe and a heat treatment process after the pipe formation. For this reason, oxide scales (hereinafter, referred to simply as "mill scales") inevitably are generated on the inner and outer surfaces of the pipe.

Normally, mill scales are completely removed by a pickling process applied after the shot blasting process. This is because, in general, it is considered that a chromium depression zone exists in the base material steel right under the mill scales and that a desirable corrosion resistance can not be obtained without removing this chromium depression zone as well as the mill scales.

The combination of the shot blasting process and the succeeding pickling process is provided because the application of only the pickling process takes a long time to completely remove the mill scales and the chromium depression zone, resulting in degradation in productivity.

However, the pickling process requires a number of sub-processes and great costs, resulting in degradation in productivity and an increase in the production costs of the products, as well as causing deterioration in working environments due to acid mist, etc. For this reason, from the viewpoints of improvements in productivity, maintenance of good working environments and reduction of the production costs of the products, there have been ever-increasing demands for the simplification of the pickling process, and further, the elimination of the pickling process.

With respect to the shot blasting process, methods are proposed in which grains made of 13% chromium steel, which is the same as the processed steel, or alumina are used as the grains for shot blasting. The reason for this is described as follows: if iron grains are used for the blasting process for stainless steel, pulverized fine particles resulting from the iron grains for shot blasting remain on the surface of the stainless steel product, and in the case when the pickling process is omitted, rust develops from the fine particles of the iron grains for shot blasting serving as starting points in atmospheric environments; this causes so-called rust deposition, resulting in deterioration in the appearance of the products. Moreover, the rust deposition serves as a starting point of the occurrence of pitting corrosion, and accelerates corrosion under actual service environments, such as, high-temperature, high-moisture environments including carbon dioxide gas and hydro-sulfide in the case of oil country tubuler goods.

However, even in the case when the grains for shot blasting made of 13% chromium steel or alumina are used, the martensitic stainless steel containing chromium in the range of 9 to 15% by weight is sometimes subjected to slight corrosion when left in atmospheric environments, if the pickling process is omitted.

Conventionally, there is hardly any researches made on the relationship between the operation conditions of the shot blasting process and the generation of rust. At present, in actual operations, a pickling process for a short period of time is further carried out after the shot blasting process, or the processing time of the shot blasting is extended sufficiently longer than is necessary so as to completely blast and remove the chromium depression zone; consequently, the efficiency of the shot blasting process deteriorates.

However, some researches have been made on not only these grains for shot blasting, but also the shot blasting method itself. More specifically, in a commonly-used shot blasting method which is a so-called pressure blast system, grains for shot blasting are discharged and blasted onto target materials together with compressed air. However, the pressure blast system has the following problems: Running costs increase because of a high power consumption of the compressor, the compressor generates a high pressure, resulting in the possibility of rupturing, and fine grains of shot blasting scatter around, causing degradation in the working environments.

For this reason, a so-called vacuum suction blast system which utilizes the air suction function of an air suction device, has been proposed as a new shot blasting method for shot blasting a pipe inner surface. For example, this method is proposed by Japan Laid-Open Patent Application No. 60-263671. Moreover, blasting devices of the vacuum suction blast system, which enhance the blasting efficiency of this method by adjusting the difference in static pressures or circulating the air flow, have been proposed by, for example, Japanese Laid-Open Patent Application No. 63-22271 and Japanese Laid-Open Patent Application No. 6-270065.

However, the objective of these conventional proposals is to make the vacuum suction blast process more efficient, and it is necessary to apply a pickling process after the shot blasting process so as to completely remove scales.

In recent years, elimination of the pickling process has been demanded as described earlier, and performances of the surface state after the shot blasting process, as it is, have become more important, however, at present, no standard has been established about the extent to which the surface state has to be finished by the shot blasting process in order to ensure a desired corrosion resistance. An excessive shot blasting process causes a reduction in productivity, and an insufficient shot blasting process causes degradation in corrosion resistance.

SUMMARY OF THE INVENTION

The objective of the present invention is to provide a martensitic stainless steel product which is superior in rust forming resistance Linder atmospheric environments even when left in a surface state after a shot blasting process as it is, and which is also superior in corrosion resistance, more specifically, in sulfide stress cracking resistance, even under service environments containing hydro-sulfide. The martensitic stainless steel product of the present invention having the surface state after a shot blasting process, as it is, does not require a pickling process during its production; therefore, this product makes it possible to improve the working environments and productivity, and also to reduce production costs.

The steel product of the present invention is a martensitic stainless steel having a chromium content of 9 to 15% by weight, and a surface state such that mill scales generated during the production have been removed from its surface by the shot blasting method. The surface state satisfies the following conditions: when a color image of the surface is analyzed with respect to blue and a tone is obtained, in a histogram of the values of the tone X and the number of pixel Y, the maximum frequency Yp of the pixels and the tone value Xp at which the maximum frequency Yp has been counted have a relationship which satisfies the following inequality:

$800Xp-Yp-27000>0$. Here, the number of the pixels of the color image is 640×480, and the tone values represent values obtained by dividing the tone of the pixels into 0 to 255 classes.

Preferably, the above-mentioned color image is a pickup image of the surface of a steel product, taken with an adjusted luminance of 200 1× by using a metal halide lamp.

The surface roughness of the steel product of the present invention is preferably set to have a maximum height Ry of not more than 80 μm, and more preferably not more than 50 μm. More specifically, in the case of the vacuum suction blast system used as the shot blasting method, it is preferably set to be not more than 80 μm, and in the case of the pressure blast system, it is preferably set to be not more than 50 μm. Here, the above-mentioned maximum height Ry refers to the maximum height standardized by JIS B 0601 (hereinafter, the same is true).

The base material may be a martensitic stainless steel which contains 9 to 15% by weight of chromium, preferably further contains not more than 0.5% carbon, not more than 1% silicon, not more than 5% manganese, 0 to 8% nickel, 0 to 7% molybdenum, 0 to 0.1% titanium, 0 to 0.1% zirconium, 0 to 0.1% niobium and 0 to 0.1% sol, aluminum.

With respect to the above-mentioned martensitic stainless steel products, in the case of a steel pipe, the surface state of at least the inner surface satisfies the above-mentioned inequality: $800Xp-Yp-27000>0$, and its surface roughness is set to be not more than 80 μm, preferably not more than 50 μm.

The above-mentioned martensitic stainless steel product is superior in weatherability under atmospheric environments during production, transportation and storage in warehouses or yards, and also superior in sulfide stress cracking resistance, under service environments containing hydro-sulfide in oil wells, chemical plants, etc.

DETAILED DESCRIPTION OF THE EMBODIMENTS

Figure 1:
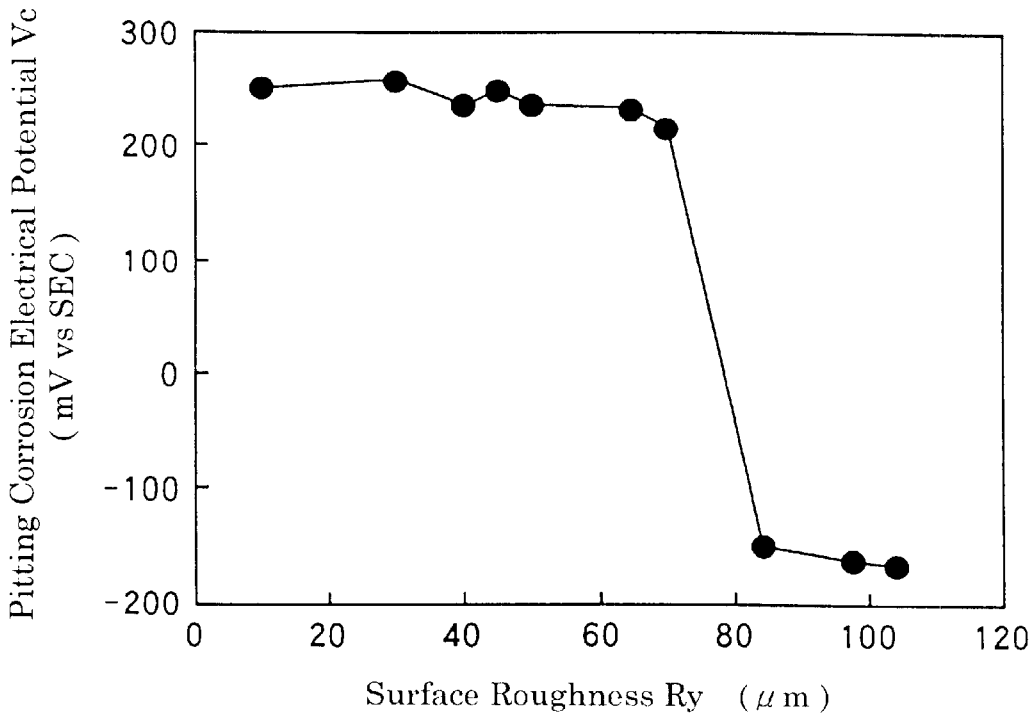
FIG. 1 is a graph that shows the relationship between the pitting corrosion electrical potential and the surface roughness in a deaerated solution containing $Cl^-$ ions of 100 ppm.

The inventors of the present invention have carried out detailed researches on influences that are exerted by the state of a steel product surface, such as pipe inner surface, having remaining mill scales and the surface roughness, as it is, after having been subjected to a shot blasting process on the rust forming resistance under atmospheric environments and the sulfide stress cracking resistance Linder service environments containing hydro-sulfide. As a result, they have found the following facts and completed the present invention.

The state of a steel product surface having, remaining mill scales after a shot blasting process gives great influences on the rust forming resistance under atmospheric environments, however it gives less influence on the sulfide stress cracking resistance under environments containing hydro-sulfide. The following description will give a detailed explanation thereof.

The reason that rust formation is influenced by the state with remaining mill scales is because the starting point of rust formation resides in a chromium depression zone right under the remaining mill scales. In other words, when mill scales exist in an amount exceeding a certain threshold value per unit area, rust generated in the chromium depression portion becomes noticeable clearly as rust.

Conventionally, the degree of remaining mill scales has been judged by workers through visual inspection and controlled so as to be less than a reference amount at which supposedly no rust is generated. However, the judgment varies greatly depending on individual workers, and when the products are left under atmospheric environments, there are variations in the degree of rust formation. Therefore, in the actual operations, a shot blasting process for a sufficiently long time is inevitably carried out so as to provide a Surface state that is finished more completely than is necessary; consequently, this causes degradation in productivity.

Therefore, in order to obtain an appropriate shot-blasted product surface free from rust formation, the state of the surface having remaining mill scales is estimated by using an image-processing, method.

More specifically, after a shot blasting process, an image of the surface of a steel product was picked up by a CCD camera with an adjusted luminance of 200 1× by using a metal halide lamp, and the pickup color image of the surface having 640× 480 pixels was inputted to an image analyzing device; thus, the resulting tone for each of the three primaries (red, blue, green) was classified into 0 to 255 classes, and a histogram was formed on the tone value X and the number of pixel Y for each tone value so that the relationship between the histogram of pixel number and the surface state after a shot blasting process was analyzed.

As a result, it was confirmed that the maximum frequency Yp of the pixel number histogram and the ton e value Xp at which the maximum frequency Yp was counted varied depending on the remaining state of mill scales after the shot blasting process. When there were few remaining mill scales., the tone value Xp at which the maximum frequency Yp had been counted became higher, while the maximum frequency Yp became lower. In contrast, where there were many remaining mill scales, the tone value Xp at which the maximum frequency Yp had been counted became lower, while the maximum frequency Yp became higher. Furthermore, it was found that, among the three primaries, the above-mentioned relationship appears most clearly in the case of blue.

Based on these findings, various specimens were prepared in which the maximum frequency Yp of the pixel number histogram with respect to blue and the tone value Xp at which the maximum frequency Yp had been counted were set at different values, and rust formation tests were carried out by using these specimens. In the tests, the specimens were left inside a constant temperature and moisture testing device having a temperature of 50° C. and a humidity of 98% for one week.

As a result, it was confirmed that in a steel product having a surface state in which the relationship between the maximum frequency Yp and the tone value Xp satisfied an inequality, $800Xp-Yp-27000>0$, no rust formation was visually observed. In contrast, in the case when the relationship between the maximum frequency Yp and the tone value Xp was represented by an inequality, $800Xp-Yp-27000\leqq 0$, rust formation was visually observed.

The reason that no rust is formed in the case when the surface state satisfies $800Xp-Yp-27000>0$is because mill scales have been sufficiently removed so that remaining, mill scale portions, which serve as starting points of rust formation, that is, the remaining areas of the chromium depression zone, have been reduced.

Therefore, in the present invention, it is defined that, in order to impart sufficient rust forming resistance to the shot blasted surface, the relationship between the maximum frequency Yp of the pixel number histogram and the tone value Xp at which the maximum frequency Yp has been counted must satisfy the inequality, $800Xp-Yp-27000>0$. In the case of the martensitic stainless steel product produced by the above-mentioned processes, the depth to the chromium depression zone right under mill scales is as small as 2 μm. For this reason, at portions where mill scales have been sufficiently removed by the shot blasting process, the base material surface portion of the steel product is also blasted and removed together with the mill scales. With this blasting and removing process, most of the shallow chromium depression zone is removed.

Furthermore, tests were carried out on the sulfide stress cracking resistance under environments containing hydrosulfide by using specimens having various degrees of remaining mill scales; however, hardly any specific differences were observed.

On the other hand, the surface roughness of a steel product after a shot blasting process gives effects on both of the rust forming resistance under atmospheric environments and the sulfide stress cracking resistance under environments containing hydro-sulfide. An explanation will be given more specifically as follows:

In atmospheric environments, even in the case when the remaining state of mill scales satisfies the above-mentioned inequality, $800Xp-Yp-27000>0$, if the surface roughness has a maximum height Ry exceeding 80 μm, regardless of shot blasting processes, the pitting corrosion electrical potential, measured in a deaerated water solution containing $Cl^-$ ions of 100 ppm, becomes extremely low as shown in FIG. 1. For this reason, when left Linder atmospheric environments for a month, rust formation was clearly observed on the steel product. In contrast, in the case of the maximum height Ry not more than 80 μm, the pitting corrosion electrical potential becomes very high, and hardly any rust formation was clearly observed even when left under atmospheric environments.

The reason that, in the case when the surface roughness has a maximum height Ry exceeding 80 μm, rust formation is clearly observed through visual inspection is because salinity and moisture suspended in the atmosphere deposit in recessed portions on the surface of the steel product to a great degree, with the result that these salinity and moisture serve as starting points of rust formation.

With respect to the generation of sulfide stress cracking under environments containing hydro-sulfide, at first, fine pits are formed by pitting corrosion, and then, stress concentration occurs at these pits serving as starting points, resulting in cracking.

Figure 2:
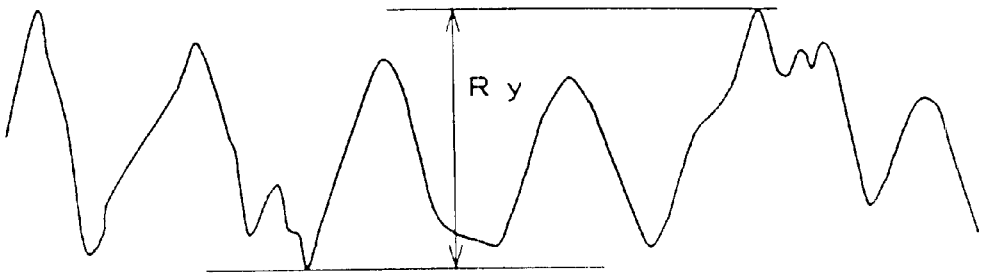
FIG. 2 is a schematic enlarged cross-sectional view that shows an irregular state of a steel product surface after having been subjected to a shot blasting process of a pressure blast system .
Figure 3:
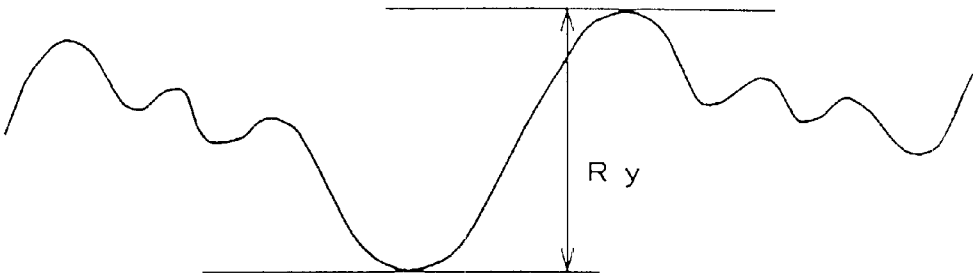
FIG. 3 is a schematic enlarged cross-sectional view that shows an irregular state of a steel product surface after having been subjected to a shot blasting process of a vacuum suction blast system.

The surface of a steel product having been subjected to a shot blasting process has a shape in which fine recesses and protrusions continuously exist. It is considered that stress concentration occurs in these recesses, resulting in sulfide stress cracking. In the case of a steel product subjected to the pressure blast system, if the surface roughness has a maximum height Ry exceeding 50 μm, the generation of sulfide stress cracking was observed, and in the case of a steel product subjected to the vacuum suction blast system, if the surface roughness has a maximum height Ry exceeding 80 μm, the generation of sulfide stress cracking was also observed. In contrast, in the case of a steel product subjected to the pressure blast system with a maximum height Ry not more than 50 μm, and in the case of a steel product subjected to the vacuum suction blast system with a maximum height Ry not more than 80 μm, neither of them were subjected to the generation of sulfide stress cracking. The reason for this is given as follows:

FIG. 2 and FIG. 3 are schematic enlarged cross-sectional views that show irregular surface states of steel products with surface roughness having virtually the same maximum height Ry, and the steel products were respectively treated by the shot blasting method of the pressure blast system and the shot blasting method of the vacuum suction blast system. FIG. 2 shows the case of the pressure blast system, and FIG. 3 shows the case of the vacuum suction blast system.

As illustrated in FIG. 3, the surface treated by the vacuum suction blast system has an irregular shape with a smooth curved edge portion. In contrast, as illustrated in FIG. 2, the surface treated by the pressure blast system has an irregular shape with a sharp burr edge portion. Stress concentration tends to occur in the bottom of each recess with a sharp notched shape, thereby forming a starting point of sulfide stress cracking. Actually, cracks were observed in the bottoms of the recesses with such a sharp notched shape. It was found that the difference in susceptibility to sulfide stress c racking is caused by the difference in such irregular shapes.

Here, the reason that the different irregular shapes are respectively formed by the pressure blast system and the vacuum suction blast system as described above is mainly because there is a difference in collision angles at which grains for shot blasting are collided onto the surface to be blasted. More specifically, in the pressure blast system, in its normal operation conditions, the angle of a nozzle for discharging grains for shot blasting is fixed at approximately 25 to 40° with respect to the surface to be blasted, and the grains for shot blasting, discharged from the nozzle, are allowed to collide with the surface to be blasted with a virtually constant collision angle.

In contrast, in the case of the vacuum suction blast system, since grains for shot blasting, supplied from one of the tube ends, are sucked from the other tube end, the collision angle of each grains for shot blasting deviates with respect to the surface to be blasted, irregularly in the range of approximately 10 to 450°. It is considered that such random collisions of the grains onto the surface to be blasted with various collision angles result in the above-mentioned irregular shape with a smooth edge portion.

Here, even in the case of the pressure blast system, the surface having an irregular shape with a smoothly curved edge portion is obtained by reducing the set angle of the nozzle. However, this extremely reduces the blasting efficiency, and is not practically used. In other words, in the case of the pressure blast system, blasting is carried out by utilizing kinetic energy exerted by grains for shot blasting that are uniformly discharged from the tip of the nozzle at the time of their first collision. Therefore, the smaller the collision angle, the greater the distance from the nozzle discharging outlet to the surface to be blasted, with the result that the grains for shot blasting are allowed to collide with the surface to be blasted only after they have lost their highest kinetic energy. Although the grains for shot blasting are allowed to collide with the surface to be blasted with their highest kinetic energy by increasing the air pressure, this requires excessive energy and results in high costs.

The following description will discuss the martensitic stainless steel product of the present invention in more detail.

First, an explanation will be given of a base material. The present invention relates to production of a martensitic stainless steel so that the base material is martensitic stainless steel at least containing 9 to 15% by weight of chromium. The content of chromium less than 9% by weight fails to ensure desired corrosion resistance, that is, more specifically, desired sulfide stress cracking resistance. In contrast, the content Of chromium exceeding 15% by weight generates a δ-ferrite phase, resulting in degradation in corrosion resistance. Moreover, the hot workability deteriorates, causing degradation in productivity, and the material cost increases, resulting in a reduction in economy. Thus, the content of chromium is set in the range of 9 to 15% by weight.

The above-mentioned base material may martensitic stainless steel containing 9 to 15% by weight of chromium. Preferably, in addition to chromium, the base material further may contain not more than 0.5% carbon, not more than 1% silicon, not more than 5% manganese, 0 to 8% nickel, 0 to 7% molybdenum, 0 to 0.1% titanium, 0 to 0.1% zirconium, 0 to 0.1% niobium and 0 to 0.1% sol. aluminum.

Next, an explanation will be given on the relationship between the surface roughness and the corrosion resistance in more detail.

With respect to the relationship between the surface roughness and the corrosion resistance, in general the rougher the surface roughness, the poorer the corrosion resistance. This is because metal ions such as $Fe^{2+}$, leached from local anodes, deposit in recesses on the irregular surface and $H^+$ ions are generated due to hydrolysis of these metal ions, with the result that corrosion is allowed to progress more easily due to a decrease in the pH value.

In the case of the martensitic stainless steel, since hydrogen intrudes into the steel as corrosion progresses under environments containing hydro-sulfide, it is sometimes subjected to sulfide stress cracking in a state where a load is imposed thereon. In this manner, when the surface is rough, the steel is more susceptible to corrosion, with the result that sulfide stress cracking is more likely to occur.

Detailed researches were made on the resistance to sulfide stress cracking of the martensitic stainless steel under environments containing hydro-sulfide. As a result, in comparison with a standard sample having a wet-polished surface, in the case of a steel product subjected to the pressure blast system, when the surface roughness has a maximum height Ry exceeding 50 μm, and in the case of a steel product subjected to the vacuum suction blast system, when it has a maximum height Ry exceeding 80 μm, the corrosion speed becomes abruptly high in both of the cases, causing an increase in the susceptibility to sulfide stress cracking and the resulting degradation in the sulfide stress cracking resistance.

However, it is confirmed that if the maximum height Ry is set to not more than 50 μm in the case of the pressure blast system, and to not more than 80 μm in the case of the vacuum suction blast system, it is possible to ensure a sulfide stress cracking resistance as high as that of the standard sample. Thus, regardless of the shot blasting processes, it is better that the surface roughness after the process is set to have a maximum height Ry of not more than 80 μm to ensure a sulfide stress cracking resistance. Moreover, in the case when mill scales on the surface of a steel product are removed by the shot blasting method of the pressure blasting system, it is better that the surface roughness after the process is set to have a maximum height Ry of not more than 50 μm to ensure both of a rust forming resistance and a sulfide stress cracking resistance.

Here, for the reasons as described earlier, the greater surface roughness after the removal of mill scales is applicable in the case of the shot blasting method of the vacuum suction blast system, as compared with the shot blasting method of the pressure blast system. In other words, in the pressure blast system, the irregular surface having a sharp burr edge portion is formed, and stress concentration occurs on the bottom of the recess having a sharp notched shape, and these recesses tend to form the starting points for cracking; in contrast, in the case of the vacuum suction blast system, the irregular surface having a smooth curved edge portion is formed, the bottoms of these recesses are less susceptible to stress concentration, and less likely to form the starting points for cracking.

The above-mentioned surface roughness is easily obtained by adjusting factors, such as the size and the charge of grains for shot blasting and the blast processing time, and the processing conditions are not particularly limited. The processing conditions of the shot blasting process include various factors, such as the property and thickness of mill scales on the surface of a steel product to be processed, the size and the charge of the grains for shot blasting, the discharging angle and air pressure in the case of the pressure blast system, and the flow rate and the size of the steel product to be processed in the case of the vacuum blast suction. These factors are closely correlated so that any change in one factor results in a change in the results of the process even if the other conditions are the same.

Here, with respect to grains for shot blasting, it is preferable to use grains made of alumina or steel grains made of the same material as the steel product to be processed. This is because to omit the pickling process after the shot blasting process is a premise of the present invention, and in the case of the application of iron grains for shot blasting, which is commonly used, pulverized fine particles of the iron grains for shot blasting, which inevitably deposit on the surface after the process, serve as starting points for rust deposition, resulting in degradation in rust forming resistance. Moreover, pitting corrosion occurs with the rust deposition serving as the starting points, resulting in degradation in corrosion resistance.

The martensitic stainless steel product of the present invention may have any shape of a steel sheet, shape steel, rod steel, a steel pipe, etc. Moreover, the steel pipe may be either a seamless pipe or a welded steel pipe, and its pipe forming method is not particularly limited. Furthermore, when the steel pipe is used for transporting fluids, such as gases and liquid, mainly its inner pipe surface demands corrosion resistance such as sulfide stress cracking resistance, and the state of the outer pipe surface need not be specifically regulated. However, since rust forming resistance is also required with respect to the outer pipe surface, it is preferable to process the outer pipe surface in the same manner as the inner pipe surface.

Moreover, in the case when the shot blasting process of the vacuum suction blast system is applied to the outer surface of a steel pipe and the surface of steel sheet, shape steel and rod steel, the steel product to be processed is placed in a vessel one end of which is connected to a supply device for grains for shot blasting, with the other end being connected to a suction device. In this case, if the steel product to be processed is a steel pipe, plugs are inserted into both of the ends; thus, only the outer surface is subjected to the process.

Additionally, in the case when iron grains for shot blasting have to be used in the shot blasting process for any reason and a pickling process is applied after the shot blasting process, with respect to the steel product s surface, the outer surface in the case of a steel pipe, that is not subjected to corrosive fluids containing hydro-sulfide, iron grains for shot blasting can be used without being limited in their kinds, and no limitation is given to the method for pickling.

Furthermore, with respect to the martensitic stainless steel product of the present invention, if its place of use, place of storage, etc. demand high corrosion resistance due to atmospheric environments such as those in beach sides, etc., and if the product is highly susceptible to rust formation, a primary rust protection process such as application of oil, etc. may be carried out, as an additional process.

EXAMPLES

Example 1

Six kinds of steels, whose chemical compositions are listed in Table 1, were prepared; and the steel Nos. a through c were used in Example 2, and steel Nos. d through f were used in Example 1. With respect to steel Nos. d through f, solid round billets of 192 mm in outer diameter and steel sheets of 6 mm in thickness, 1015 mm in width and 30 m in length were respectively prepared.

TABLE 1

| Steel | Chemical Composition (wt. %) | | | | | | | |
|---|---|---|---|---|---|---|---|---|
| No. | C | Si | Mn | P | S | Ni | Cr | Mo |
| a | 0.18 | 0.19 | 0.51 | 0.022 | 0.003 | 0.07 | 12.9 | 0.01 |
| b | 0.05 | 0.25 | 1.13 | 0.018 | 0.001 | 1.72 | 10.7 | 0.01 |
| c | 0.01 | 0.22 | 0.28 | 0.012 | 0.001 | 5.9 | 12.2 | 1.95 |
| d | 0.19 | 0.18 | 0.53 | 0.023 | 0.003 | 0.08 | 12.8 | 0.01 |
| e | 0.03 | 0.28 | 1.15 | 0.018 | 0.001 | 1.89 | 10.9 | 0.11 |
| f | 0.01 | 0.19 | 0.22 | 0.018 | 0.001 | 5.8 | 12.1 | 2.02 |

Note: The rest of the composition is virtually iron.

After having been heated to 1250° C., the solid round billets piered into a hollow shell by using a piercer mill, and then successively formed into a mother pipe for finish rolling by a mandrel mill, and after having been reheated to 1100° C., this was finished to a seamless steel pipe by a stretch reducing mill so as to have 63 mm in outer diameter and 6 mm in thickness, and then cut so as to have 12 m in length.

Moreover, with respect to a steel sheet having 6 mm in thickness, 1015 mm in width and 30 m in length, this was formed into a pipe having 323 mm in outer diameter and 6 mm in thickness, and then seam welded in the length direction by using a laser welding method, and this is then cut so as to provide a laser welded steel pipe having 12 m in length.

The respective resulting steel pipes were subjected to a quenching process in which they were heated to 950° C. and maintained at this temperature for 60 minutes and then cooled off by air, and then subjected to a tempering process in which they were heated to 650° C. and maintained at this temperature for 30 minutes and then cooled off by air; thus, steel pipes with mill scales were prepared. Here, with respect to steel No. f, it may be subjected to a quenching process in which after heated and maintained, this is cooled off by water; however, in the present example, the quenching process which uses cooling by air after the steel product has been heated and maintained was adopted.

Shot blasting processes of the vacuum suction blast system and the pressure blast system using alumina grains for shot blasting were respectively carried out on the inner surface of the steel pipes with mill scales thus obtained; consequently, pipes having various mill scale remaining states were obtained with their inner surfaces adjusted to various degrees of surface roughness.

With respect to each of the steel pipes which had been subjected to the shot blasting processes, a color image of the inner surface was picked up by a CCD camera, and the color image thus picked up was analyzed with respect to blue so as to form a pixel number histogram with the tone of 0 to 255 classes, and the maximum frequency Yp and the tone value Xp at which the maximum frequency Yp had been Counted were found. In this case, the image pickup by the CCD camera was carried out with an adjusted surface luminance of 200 1× by using a metal halide lamp. Moreover, the image analysis was carried out by dividing an image obtained on an area of 36 mm×30 mm into pixels consisting of 640×480.

Specimens were taken from the portions of the steel pipes after having been subjected to the image analysis, and underwent tests for sulfide stress cracking and simulation tests for rust formation as described below.

Tests for sulfide stress cracking:

Four-point bent beam specimens having 2 mm in thickness, 10 mm in width and 75 mm in length were prepared with the inner pipe surface having been subjected to the shot blasting process left as it was, and these underwent tests for sulfide stress cracking under any one of the following 3 test conditions A to C shown in Table 2.

TABLE 2

| Test condition | Hydro-sulfide atm | Carbon dioxide gas atm | NaCl (%) | pH | Temperature (° C.) | Period of immersion hr |
|---|---|---|---|---|---|---|
| A | 0.003 | 30 | 10 | 3.5 | 25 | 720 |
| B | 0.001 | | 1 | 4.5 | | |
| C | 0.01 | | 5 | 4.0 | | |

In this case, in order to obtain a reference value, four-point bent beam specimens, which had the same shape and dimension as those as described above and which were finished through wet polishing by using emery paper (#600) on the entire surface, were prepared, and these also underwent the same tests for sulfide stress cracking. Moreover, a bending strain causing a bending stress corresponding 100% of the 0.2% yield stress of each steel specimen was applied to the four-point bent beam specimen.

After the tests, each of the specimens was observed on its surface with naked eye and examined on its cross-section by an optical microscope so as to examine the presence of cracking. Under the condition where no sulfide stress cracking occurred in the reference specimen which has the entire polished surface, those on which cracking was observed were estimated as being inferior "x ", and those on which no cracking was observed were estimated as being superior "○".

Rust formation simulation test:

Rectangular-shaped specimens having 3 mm in thickness and 20 mm in length were prepared with the inner pipe surface having been subjected to the shot blasting process left as it was, and these underwent rust formation simulation tests in the following sequence of processes. The specimen was immersed in a water solution prepared by diluting synthetic seawater by 1000 times of water, and then taken out and dried so as to allow salt to deposit on its surface, and this was exposed to ambient temperature of 50° C. and relative humidity of 98% for a week.

In this case, in order to obtain a reference value, specimens, which had the same shape and dimension as those as described above and which were finished through wet polishing by using emery paper (#600) on the entire surface, were prepared, and these also underwent the same rust formation simulation tests.

After the tests, with respect to the surface of each specimen treated by the shot blasting, visual observations were carried out so as to examine it for the presence of discolored portions visually confirmed clearly, that is, the presence of rust, and for the ratio of generation area. The ratio of generation area of rust not less than 5% was estimated as being inferior "x", and the ratio of less than 5% was estimated as being superior "○".

Table 3 shows the results of the above-mentioned researches, together with the results of the image analyses, that is, the remaining states of mill scales. Here, Table 3 also shows general estimations, and in the general estimations, those which are superior both in sulfide stress cracking resistance and in rust forming resistance are ranked as "◎"; those which are

TABLE 3

| Specimen No. | Steel No. | Pipe making method | Shot blasting system | Surface roughness Ry (μm) | Sulfide stress cracking resistance: Test conditions | SSC | Evaluation | Pickup image analysis: Yp | Xp | Calculated value | Rust forming resistance: Rust formation area rate (%) | Evaluation | General evaluation |
|---|---|---|---|---|---|---|---|---|---|---|---|---|---|
| 1 | d | M/M Seamless pipe | Pressure | 45 | A | None | ○ | 3500 | 75 | 29500 | 3 | ○ | ◎ |
| 2 | e | making method | blast | 42 | B | None | ○ | 4200 | 61 | 17600 | 2 | ○ | ◎ |
| 3 | f | Laser welding-pipe making method | | 35 | C | None | ○ | 2000 | 130 | 7500 | 1 | ○ | ◎ |
| 4 | d | M/M Seamless pipe | | 48 | A | None | ○ | 4000 | 70 | 25000 | 3 | ○ | ◎ |
| 5 | | making method | Suction | 20 | | None | ○ | 2100 | 110 | 58900 | 2 | ○ | ◎ |
| 6 | | | blast | 18 | | None | ○ | 1900 | 105 | 55100 | 1 | ○ | ◎ |
| 7 | | | system | 76 | | None | ○ | 3500 | 70 | 25500 | 3 | ○ | ◎ |
| 8 | | | Pressure blast | 32 | | None | ○ | 7000 | 42 | *−400 | 12 | x | ○ |
| 9 | | | Suction blast system | 61 | | None | ○ | 6800 | 40 | *−1800 | 30 | x | ○ |
| 10 | | | Pressure blast | *57 | | Present | x | 3200 | 68 | 24200 | 3 | ○ | Δ |
| 11 | | | Suction blast system | *88 | | Present | x | 7200 | 38 | *−3800 | 80 | x | x |

TABLE 3-continued

| Specimen No. | Steel No. | Pipe making method | Shot blasting system | Surface roughness Ry (μm) | Sulfide stress cracking resistance: Test conditions | SSC | Evaluation | Pickup image analysis: Yp | Xp | Calculated value | Rust forming resistance: Rust formation area rate (%) | Evaluation | General evaluation |
|---|---|---|---|---|---|---|---|---|---|---|---|---|---|
| 12 | | | | *93 | | Present | x | 5500 | 15 | 8300 | 15 | x | x |
| 13 | | | (Polishing) | | | None | — | — | — | — 0 | | — | — |
| 14 | e | | | | B | None | — | — | — | — 0 | | — | — |
| 15 | f | | | | C | None | — | — | — | — 0 | | — | — |

Note: The calculated value in "pickup image analysis" is obtained from an inequality, "800Xp − Yp − 27000 > 0".

superior in sulfide stress cracking resistance but inferior in rust forming resistance are ranked as "○" those which are superior in rust forming resistance but inferior in sulfide stress cracking resistance are ranked as "Δ"; and those which are inferior both in sulfide stress cracking resistance and in rust forming resistance are ranked as "x".

As clearly shown by Table 3, among the steel pipes of specimens 1 to 7 as well as 10 and 11 which satisfy the relationship between the maximum frequency Yp of the pixel number histogram as the results of the image analysis of the inner surface and the tone value Xp at which the maximum frequency Yp has been counted satisfies an inequality, 800Xp−Yp−27000>0, the steel pipes of specimens Nos. 1 to 7 are superior in both rust forming resistance and sulfide stress cracking resistance.

In contrast, those steel pipes of specimens Nos. 8, 9 and 11, which do not satisfy the inequality, 800Xp−Yp−27000>0, are all inferior in rust forming resistance independent of the surface roughness Ry.

Here, among those steel pipes that satisfy the inequality, 800Xp−Yp−27000>0, the steel pipe of specimen No. 10 that has been subjected to the shot blasting process of the pressure blast system is inferior in sulfide stress cracking resistance, since its surface roughness Ry is 57 μm exceeding 50 μm.

Moreover, the steel pipe of specimen No. 12 that has been subjected to the shot blasting process of the vacuum suction blast system is inferior in both rust forming resistance and sulfide stress cracking resistance, since its surface roughness Ry is 88 μm exceeding 80 μm.

Therefore, in the case when a sufficient sulfide stress cracking resistance is demanded, it is preferable to set the surface roughness so as to have a maximum height Ry of not more than 80 μm.

Moreover, among those steel pipes that do not satisfy the inequality, 800Xp−Yp−27000>0, the steel pipes of specimens Nos. 8 and 9 are superior in sulfide stress cracking resistance since their surface roughness Ry are 32 μm within not more than 50 μm, and 61 μm within not more than 80 μm, respectively.

Example 2

Among the six kinds of steels whose chemical compositions are listed in Table 1, steel Nos. a through c were used in Example 2. With respect to these steels, solid round billets of 192 mm in outer diameter and two kinds of steel sheets of 6 mm in thickness, 1015 mm in width and 30 m in length as well as 25 mm in thickness, 1915 mm in width and 12 m in length were respectively prepared.

After having been heated to 1250° C., the solid round billet was pierced into a hollow shell by using, a piercer mill, and then successively formed into a mother pipe for finish rolling by a mandrel mill, and after having been re-heated to 1100° C., this was finished to a seamless steel pipe by a stretch reducing mill so as to have 63 mm in outer diameter and 6 mm in thickness, and then cut so as to provide a pipe having 12 m in length.

Moreover, with respect to the steel sheet having 6 mm in thickness, 1015 mm in width and 30 m in length, this was formed into a pipe having 323 mm in outer diameter and 6 mm in thickness, and then seam welded in the length direction by using a laser welding method, and this was then cut so as to provide a laser welded steel pipe having 12 m in length.

With respect to the steel sheet having 25 mm in thickness, 1915 mm in width and 12 m in length, this was formed into a pipe shape by using a U press and then an O press, and then seam welded by a submerged arc welding method by using a welding material of two-phase stainless steel (corresponding to SUS329J4L, standardized by JIS), thereby preparing a UO welded pipe having 609 mm in outer diameter, 25 mm in thickness and 12 m in length.

The respective resulting steel pipes were subjected to a quenching process in which they were heated to 950° C. and maintained at this temperature for 60 minutes and then cooled off by air, and then subjected to a tempering process in which they were heated to 650° C. and maintained at this temperature for 30 minutes and then cooled off by air; thus, steel pipes with mill scales were prepared. Here, with respect to steel No. c, it may be subjected to a quenching process in which after heated and maintained, this is cooled off by water; however, in the present example, the quenching process which uses cooling by air after the steel product has been heated and maintained was adopted.

Shot blasting processes of the vacuum suction blast system and the pressure blast system using alumina grains for shot blasting were respectively carried out on the inner pipe surface of the steel pipes so as to remove the mill scales therefrom; thus, the surface was finished so as to satisfy the above-mentioned inequality, 800Xp−Yp−27000>0, and their surfaces were adjusted to various degrees of roughness, and used for the following sulfide stress cracking tests.

Tests for sulfide stress cracking:

Four-point bent beam specimens having 2 mm in thickness, 10 mm in width and 75 mm in length were formed with the inner pipe surface having been subjected to the shot blasting process left as it was, and these underwent tests for sulfide stress cracking under any one of the following 3 test conditions A to C shown in Table 2.

In this case, in order to obtain a reference value, four-point bent beam specimens, which had the same shape and dimension as those as described above and which were finished through wet polishing by using emery paper (#600) on the entire surface, were prepared, and these also underwent the same tests for sulfide stress cracking. Moreover, a bending strain causing a bending stress corresponding 100% of the 0.2% yield stress of each steel specimen was applied to the four-point bent beam specimen.

After the tests, each of the specimens was observed on its surface by naked eye and examine on its cross-section by an optical microscope so as to examine the presence of cracking. Under the condition where no sulfide stress cracking occurred in the reference specimen which has the entire polished surface, those on which cracking was observed were estimated as being inferior "x", and those on which no cracking was observed were estimated as being superior "○". The results are collectively shown in Table 4.

Table 4 clearly shows that the steel pipes (specimen Nos. 16 to 19, 23, 24, 28 and 29) of Examples of the present invention, which have been subjected to the shot blasting process of the vacuum suction blast system so as to remove mill scales from the steel pipe inner surface and which have a surface roughness after the process with a maximum height Ry of not more than 80 μm, exhibit virtually the same corrosion resistance (sulfide stress cracking resistance) as the reference steel pipes (specimen Nos. 22, 27 and 32).

In contrast, the steel pipes of comparative examples (specimen Nos. 21, 26 and 31), which have a surface roughness after the shot blasting process of the vacuum suction blast system with a maximum height Ry exceeding 80 μm, and the steel pipes of comparative examples (specimen Nos. 20, 25, 30), which have a surface roughness after the shot blasting process of the pressure blast system with a maximum height Ry exceeding 50 μm, are inferior in corrosion resistance (sulfide stress cracking resistance) as compared with the reference steel pipe.

TABLE 4

| Specimen No. | Steel No. | Pipe making method | Surface roughness Ry (μm) | Shot blasting method | Corrosion resistance Test conditions | SSC | Evaluation | Case difference |
|---|---|---|---|---|---|---|---|---|
| 1 | a | M/M Seamless pipe making method | 45 | Suction blast system | A | None | ○ | Examples |
| 2 | | | 68 | | | None | ○ | |
| 3 | | Laser welding-pipe making method | 72 | | | None | ○ | |
| 4 | | UO welding-pipe making method (SAW) | 77 | | | None | ○ | |
| 5 | | | *71 | Pressure blast system | | Present | x | Comparative |
| 6 | | | *93 | Suction blast system | | Present | x | examples |
| 7 | | | | (Polishing) | | None | — | Reference |
| 8 | b | M/M Seamless pipe making method | 24 | Suction blast system | B | None | ○ | Examples |
| 9 | | | 69 | | | None | ○ | |
| 10 | | | *58 | Pressure blast system | | Present | x | Comparative |
| 11 | | | *85 | Suction blast system | | Present | x | examples |
| 12 | | | | (Polishing) | | None | — | Reference |
| 13 | c | | 32 | Suction blast system | C | None | ○ | Examples |
| 14 | | | 76 | | | None | ○ | |
| 15 | | | *70 | Pressure blast system | | Present | x | Comparative |
| 16 | | | *102 | Suction blast system | | Present | x | examples |
| 17 | | | | (Polishing) | | None | ○ | Reference |

Note) Symbol *indicates that the value deviates from the range specified by the present invention.

The martensitic stainless steel product of the present invention is superior in corrosion resistance, more specifically, in rust forming resistance and further sulfide stress cracking resistance, even when the surface thereof is left as it is after a shot blasting process. Moreover, this steel product is readily finished so that the surface state allows to satisfy a specific value obtained from the results of an image analysis made by a color image of its surface, and also have a specific surface roughness; therefore, it is possible to omit a pickling process, to reduce the production cost, and also to improve the working environments.

What is claimed is:

1. A martensitic stainless steel product having a chromium content of 9 to 15% by weight and a surface from which mill scales are removed by a shot blasting, the surface having a roughness having a maximum height Ry of not more than 80 μm and the surface satisfying an inequality, $75000 \geqq 800Xp - Yp - 27000 > 0$, at an analysis of blue color in a color image of the surface taken with 640×480 pixels, wherein Yp represents the maximum frequency in a histogram of the pixel numbers and the tones divided into 0 to 255 classes and Xp represents the tone value at which Yp is counted.

2. The martensitic stainless steel product according to claim 1, wherein the color image of the surface is taken under 200 1× of luminance adjusted by using a metal halide lamp.

3. The martensitic stainless steel product according to claim 1, wherein the surface has a roughness having a maximum height Ry of not more than 50 μm.

4. The martensitic stainless steel product according to claim 2, wherein the surface has a roughness having a maximum height Ry of not more than 50 μm.

5. The martensitic stainless steel product according to claim 1, wherein the martenisitic stainless steel further comprises, by weight, not more than 0.5% carbon, not more than 1% silicon, not more than 5% manganese, 0 to 8% nickel, 0 to 7% molybdenum, 0 to 0.1% titanium, 0 to 0.1% zirconium, 0 to 0.1% niobium and 0 to 0.1% sol. aluminum.

6. The martensitic stainless steel product according to claim 2, wherein the martensitic stainless steel further comprises, by weight, not more than 0.5% carbon, not more than 1% silicon, not more than 5% manganese, 0 to 8% nickel, 0 to 7% molybdenum, 0 to 0.1% titanium, 0 to 0.1% zirconium, 0 to 0.1% niobium and 0 to 0.1% sol. aluminum.

7. The martensitic stainless steel product according to claim 1, wherein the product is a seamless steel pipe having the surface state on at least an inner surface of the pipe.

8. The martensitic stainless steel product according to claim 1, wherein the product is a welded steel pipe having the surface state on at least an inner surface of the pipe.

9. The martensitic stainless steel product according to claim 2, wherein the product is a seamless steel pipe having the surface state on at least an inner surface of the pipe.

10. The martensitic stainless steel product according to claim 2, wherein the product is a welded steel pipe having the surface state on at least an inner surface of the pipe.

* * * * *